United States Patent [19]

Cipriano et al.

[11] Patent Number: 4,807,653

[45] Date of Patent: Feb. 28, 1989

[54] CONTINUOUS TREATING OF A STRIP-LIKE PRODUCT

[75] Inventors: Anthony P. Cipriano, New Castle, Pa.; Howard J. Bortmas, Niles, Ohio

[73] Assignee: Wean Industries, Inc., Youngstown, Ohio

[21] Appl. No.: 8,911

[22] Filed: Jan. 30, 1987

[51] Int. Cl.[4] ..... B08B 3/04

[52] U.S. Cl. ..... 134/64 R

[58] Field of Search ..... 134/64 P, 64 R, 122 P, 134/122 R, 199; 266/102, 110, 111, 113; 68/5 E, DIG. 1; 285/55

[56] References Cited

U.S. PATENT DOCUMENTS

| | | | |
|---|---|---|---|
| 184,599 | 11/1876 | Ehrhardt . | |
| 966,513 | 8/1910 | Avery . | |
| 1,043,412 | 11/1912 | Faunce . | |
| 1,837,159 | 12/1931 | Fellows . | |
| 1,886,421 | 11/1932 | Perkins . | |
| 1,998,192 | 4/1935 | Haswell | 266/6 |
| 2,065,480 | 12/1936 | Soper | 113/120 |
| 2,126,505 | 6/1937 | Risser | 285/129 |
| 2,212,588 | 8/1940 | Csanji | 266/6 |
| 2,234,815 | 3/1941 | Wood | 266/3 |
| 2,264,885 | 12/1941 | Mueller | 266/3 |
| 2,721,562 | 10/1955 | Irvine | 134/64 R |
| 3,032,890 | 5/1962 | Brick | 34/92 |
| 3,046,771 | 7/1962 | Bailey | 68/5 E |
| 3,048,383 | 8/1962 | Champlin | 266/5 |
| 3,048,503 | 8/1962 | Foote | 134/9 |
| 3,291,468 | 12/1966 | Albertsen | 266/3 |
| 3,329,542 | 7/1967 | Stiehl | 134/64 R |
| 3,625,232 | 12/1971 | Speelmanns | 134/122 |
| 3,803,996 | 4/1974 | Marshall | 134/64 R |
| 4,181,091 | 1/1980 | Cofer et al. | 134/64 R |
| 4,209,345 | 6/1980 | Germain | 266/111 |
| 4,313,625 | 2/1982 | West | 285/55 |
| 4,388,120 | 6/1983 | West et al. | 134/64 R |
| 4,433,861 | 2/1984 | Kreczik | 285/305 |
| 4,604,157 | 8/1986 | Damiron et al. | 134/122 R |

FOREIGN PATENT DOCUMENTS

| | | | |
|---|---|---|---|
| 878044 | 9/1961 | United Kingdom | 134/64 R |
| 1143224 | 2/1969 | United Kingdom . | |

*Primary Examiner*—Harvey C. Hornsby
*Assistant Examiner*—Corinne M. Reinckens
*Attorney, Agent, or Firm*—Suzanne Kikel

[57] ABSTRACT

A system for pickling hot rolled carbon steel strip with hydrochloric acid completely and uniformly in optimum time. The system consists of a series of cells made up of a number of section modules, each having a straight narrow passageway with monolithic top and bottom walls through which the strip and pickling liquor travels and a pair of cooperative conduits in the top and bottom walls for introducing the fluid into the passageway. A wringer roll assembly with motor driven wringer rolls push the strip through each cell and consists of a housing having walls closely spaced to the rolls and a sealing element in the walls for the concentration of acid in each individual cell. The rate of pickling on the strip is increased due to the turbulence of the circulating pickling liquor within each cell, the higher temperatures, and the high concentration in each cell; the latter two of which are due to the design of the section modules.

15 Claims, 6 Drawing Sheets

CONTINUOUS TREATING OF A STRIP-LIKE PRODUCT

BACKGROUND OF THE INVENTION

1. Field of the Invention

This invention relates to a system and apparatus for the continuous surface treatment of a strip or web-like product, i.e. surface treatment particularly, but not exclusively, of a ferrous hot rolled strip in a processing line. More particularly, it relates to a sealed system comprising a plurality of cells, wherein the treatment fluid, such as hydrochloric acid or pickling liquor, is introduced at various locations to both the top and bottom of the product in each cell and is restricted in a space along the product and retained in the cell such that the treatment rate is significantly increased.

2. Description of the Prior Art

Conventionally, in the manufacture of ferrous articles, such as rolled metal strip, the article is taken through several treatment processing lines in the mill in order to produce a high quality product. These processes include pickling, cleaning, plating, coating, and/or other chemical treatment of the article. A demand for an increase in productivity in the recent years has required higher operating speeds of the processing lines, resulting in an increase both in the length of the line and in the operating and equipment costs.

Normally, the first step in finishing hot rolled ferrous strip is a descaling or pickling process, and then a rinsing of the metal strip, whereby in the pickling process the oxides and scales are chemically removed from both the top and bottom surfaces of the strip. It has become the general practice to pull strip by motor driven bridle rollers or by a tension bridle in a catenary fashion under a controlled speed through a series of three or four open troughs or tanks each typically measuring eighty to a hundred feet in length. These long, open tanks which usually have removable covers and are operated at slightly less than atmospheric pressure not only limit the speed in which the strip can travel in order to maintain the catenary condition and limit the tempratures at which pickling can be conducted without causing excessive evaporation losses of both water and acid, but they are relatively placid baths which tend to retard the chemical action because of relatively stagnant conditions of the pickling liquor near the strip surfaces.

To obviate evaporation and other losses, to conserve heat and pickling solution, and to accelerate the surface treatment process, the opened trough systems have been replaced with closed systems in the forms of troughs, chambers, tubes, and cells.

U.S. Pat. No. 1,837,159 discloses an elongated closed tube for pickling a moving strip whose edges are supported along the walls, thus minimizing friction upon the travel of the strip and permitting a substantial portion of the strip to be acted upon by the pickling solution.

U.S. Pat. No. 3,032,890 discloses a series of chambers including a central treating chamber for a strip or web and adjacent inlet and outlet chambers which evacuate the atmospheric gases so that treatment of the strip can more efficiently occur in the central treating chamber. The inlet and outlet chambers have a sealing structure comprising a pair of rollers for contacting the strip, and sealing plates of low friction material held in the housing of the sealing structure.

At the peripheries of the rollers the gas is caused to flow rapidly through the restricted orifices after which the gas is caused to enter a pocket where the gas expands and looses velocity.

U.S. Pat. No. 3,048,503 discloses recirculating pickling liquor to a sealed pickling chamber having air tube sealing means. U.S. Pat. No. 2,264,885 discloses a strip treating apparatus including plural pickling chambers each having circulating pickling liquor. In U.S. Pat. No. 2,234,815, a continuous strip pickling and cleaning apparatus is disclosed consisting of a pickling trough made up of multiple sections or modules. Several treatment chambers are combined in British Pat. No. 1,143,224 to form a continuous treatment line for the continuous surface treatment of strip and other simple shape objects. Pairs of rollers are arranged at the beginning and end of the line, as well as between the various chambers in order to convey the strip through the line.

The closed surface treatment systems of the sort mentioned above may to some extent minimize the evaporation losses of the solution; however, many fail in permitting an increase in the speed of the strip through the line, and most importantly, fail to uniformly treat the surfaces and to increase the speed or rate at which the treatment occurs upon the surface of the strip in its travel, all of which neglect to provide an optimum efficiency and productivity for the processing line.

SUMMARY OF THE INVENTION

It is therefore an object of the present invention to provide a surface treatment system which completely and uniformly treats the surfaces of the product, which optimizes the speed in which the product can travel through the system, and which optimizes the rate at which the treatment occurs on the surface of the product. The treating fluid is delivered to the top and bottom of the product at several locations at equal flow rates and at a pressure such that the velocity, and hence turbulence of the fluid is increased.

A further object of the invention is to provide a surface treatment facility which eliminates the ever present problem of overtreating a continuous strip, which eliminates the need for catenary control of the strip-like product, and which requires minimum power and control of the drive motors since high product tension is not required.

A still further object of the invention is to provide a closed system for pickling with hydrochloric acid, hot rolled steel strip in an acid-free environment thereby minimizing maintenance of the area and equipment and providing a healthy environment for the worker.

It is a further object of the invention to provide a closed surface treatment system which can be installed in existing processing lines, or which can shorten the length of the existing processing lines and still increase the treatment rate of the product thereby reducing both equipment and operational costs.

More specifically, it is an object of the invention to provide a system for the surface treatment of a strip-like material, which system comprises a series of cells which may be four or more depending on the required strip speed, etc. Each cell consists of a number of identical section modules each having top and bottom inlet channels at several locations in the cell for directing the treatment fluid onto the top and bottom surfaces of the material and having straight, narrow passageways through which the material and treatment fluid are forced. The treating fluid is delivered in near equal pressures and flow rates to the top and bottom of the product creating an hydraulic bearing on the product such as to keep the product away from the top and bottom walls of the section modules and to propel the product through the cells. The top and bottom inlets for delivering the treatment fluid are located in pairs along several locations in each cell whereby the rate at which the fluid travels accumulates as it passes each inlet location thereby increasing the treatment rate of the product. A wringer roll assembly is positioned at the beginning and end of the line and between each adjacent cell, and is constructed such as to drive the material through the cells and to seal and maintain the concentration of fluid circulating in each individual cell discrete so that the treatment occurs independently in each cell. The treatment fluid in each cell is drained at one end of each cell into its storage tank from which it is recirculated. The turbulence of the fluid relative to the moving strip, which is a result of the restricted area of the passageways in each cell, in concert with allowable higher operating temperatures and the undiluted concentration of the fluid, increases the speed or rate of treatment. Each cell has its own fluid recirculating system. The storage tank for each downstream cell can be located in a higher level from its adjacent cell to give a general counter flow cascade effect by gravity flow. The physical circulation of the treating fluid within any cell can be in the same direction of strip travel, or opposed to it. However, the net flow of the treatment fluid should be in the opposite sense of direction to that of the strip.

A further object of the invention is to provide a plurality of cells each comprising one or more section modules between each sealing-wringer roll assembly. Each section module comprises at least a top monolithic wall and a bottom monolithic wall forming a narrow-straight passage for retaining a shallow bath of treating fluid through which the product travels totally immersed in the fluid. Inlet pipe nozzles are located in the top and bottom of each section module wall at several locations in each cell to receive the treating fluid. Each module wall is composed of a granite or similar acid proof monolithic material, and a supplementary acid-proof masonry with smooth, uninterrupted surfaces running parallel to a passline for the product. The top module wall acts as a lid to fit onto the bottom wall which has a cut-out section measuring approximately 2.00 in depth and 84.00 inches wide. These walls are surrounded by an acid-proof, thermal insulation and a rubber-lined steel outer wall.

Still a further object of the invention is to provide a novel construction for a wringer roll assembly whereby the area around the pair of cooperative rolls is spaced closely around the periphery of the rolls and together with the wiper seals restrict and retain the fluid within its own cell. A drain communicating with a fluid recirculating system is located below the rolls to catch and conduct the fluid back to its storage-circulation tank.

A yet further object of the invention is to provide a simple, inexpensive clamping means for easily joining and disassembling the section modules relative to each other and to the wringer roll assembly.

These and other objects of the invention will be more fully understood and appreciated from the following description of the invention, on reference to the illustrations appended hereto.

DETAILED DESCRIPTION OF THE DRAWINGS

Figure 1:
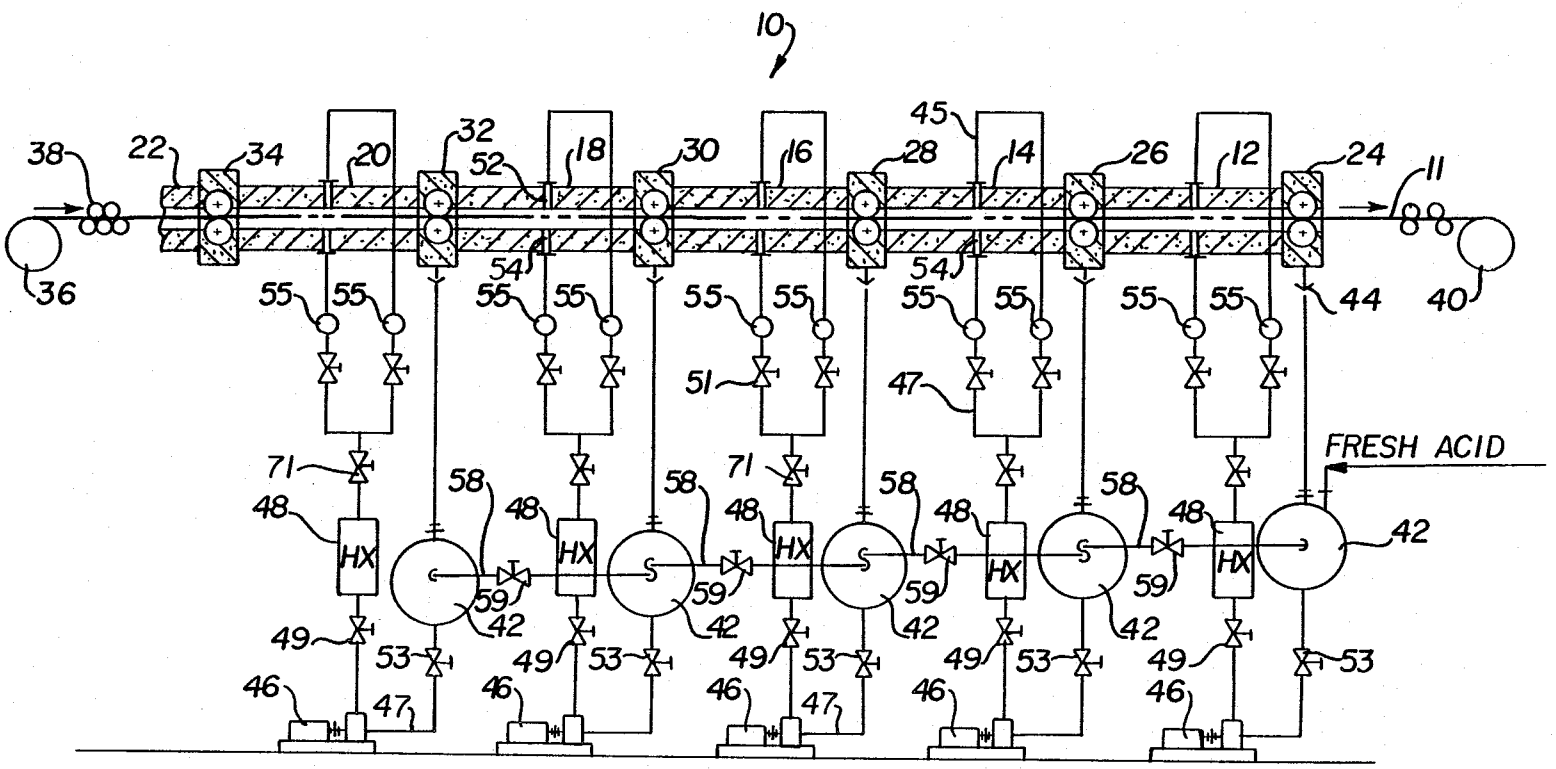
FIG. 1 is a general schematic of a pickling arrangement comprising several cells and their wringer roll assembly and circulation system.

With reference to FIG. 1, there is shown a pickling arrangement 10 for descaling or removing oxides from the surfaces of a hot rolled carbon steel strip 11 with hydrochloric acid. Pickling arrangement 10 comprises a plurality of cells some of which are shown at 12, 14, 16, 18, 20 and 22, and each consisting of a sealing-wringer roll assembly 24, 26, 28, 30, 32, 34 respectively disposed between each two adjacent cells. To the left of FIG. 1, there is shown an initial coil 36 of steel strip, being led from the coiler through a leveler 38, and passing through cells 12–22 and wringer roll assemblies 24–34 along a passline which generally is taken as shown by strip 11 and to a coiler 40 at the far right of FIG. 1. To the bottom of this FIG. 1, there is shown beneath pickling arrangement 10 a number of fluid circulation systems for receiving the large volumetric flow of partially used hydrochloric acid, which recirculates through each cell 12–22 as indicated by the arrows in the loop to the far left of FIG. 1. The storage tank also receives the lower volumetric flow of fresh acid or pickling liquor overflowing from its downstream storage tank wherein it is mixed for the supply of enriched hydrochloric acid to the pickling cell 12–22.

Figure 2:
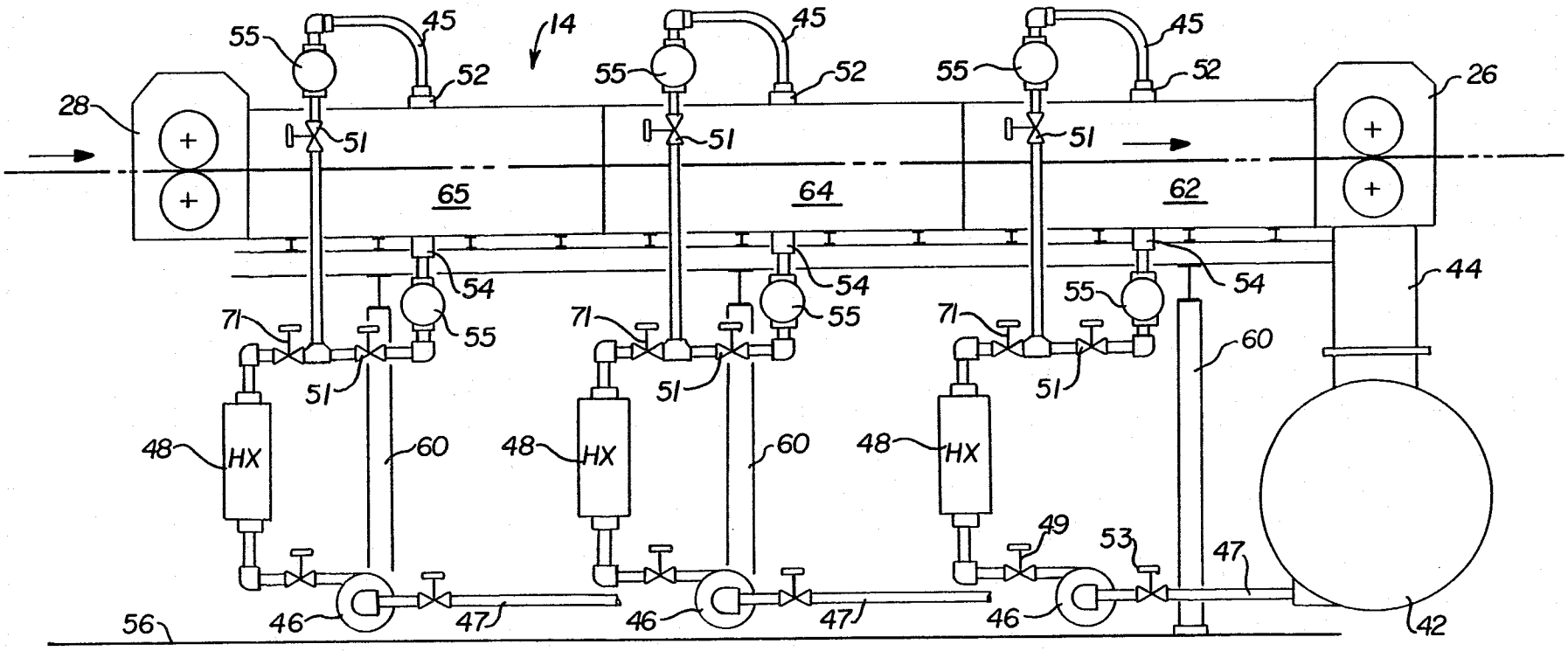
FIG. 2 is a general schematic of a cell with a wringer roll assembly and a circulating system.

FIG. 2 better shows a typical pickling cell with its respective wringer roll assemblies 26 and 28. As shown in FIG. 2, the circulation system for cell 14 consists of a storage tank 42 communicating with a drain below wringer roll assembly 26 through pipe 44, pumps 46, and heat exchangers 48. Each heat exchanger 48 is connected through pipes 47 in FIG. 2 but, whereby an enriched concentration of pickling liquor is brought into cell 14 through top conduits 52 and bottom conduits 54, more about which will be discussed shortly. The supply of fresh or richer pickling liquor is brought into the circulation storage tank 42 and pumped into the heat exchangers 48 through supply lines 47. As shown in FIG. 2, pickling arrangement 10 is elevated off of mill floor 56 by a number of structural supports 60. The hydrochloric acid or pickling liquor forced into cell 14 at the several locations flows toward wringer roll assembly 26 where through drain pipe 44 it is taken into storage tank 42. There, a fresh or fresher supply is added and mixed with the returning solution, it is pumped to heat exchangers 48 and delivered through conduits 52, 54 to cell 14.

FIG. 1 shows in schematic form, a number of storage tanks 42 and a number of overflow supply lines 58, which interconnects storage tanks 42. For each cell 12–22, there exists an arrangement for the fluid circulation system similar to that shown in FIG. 2 and shown schematically as a single loop in FIG. 1. That is, each cell 12–22 independently has storage tank 42, pumps 46, supply line 47, heat exchangers 48, and feed lines to conduits 52, 54.

As can be best observed in FIG. 1, the storage tank 42 for each individual cell 12–22 is interconnected. This interconnection is indicated by the horizontal line 58 between each succeeding storage tank. From right to left of FIG. 1, it can be seen that these horizontal interconnecting lines 58 appear in a lower elevation between succeeding storage tanks 42. Due to the difference of elevation of each horizontal connecting line 58, a cascading effect occurs when valves 59 are open whereby each storage tank 42 operates at a different level. As the pickling liquor flows from right to left of FIG. 1, from one storage tank 42 to another, circulated through corresponding pickling cells 12–22, a portion of the acid is intermixed changing the constituency, but the volumetric cascade flow which for example, could be in a range of 0 to 20 gallons per minute generally remains the same.

In order to attain thorough mixing and agitation of solution at the strip surfaces throughout the length of each cell a high volumetric rate is delivered to conduits 52, 54. They are provided along the centerline at various locations of each cell 12–22. As particularly shown in FIG. 2, different section modules 62, 64, and 65, constitute cell 14. Each remaining cell 12, 16, 18, 20, and 22 (FIG. 1) preferably consists of one or more section modules similar to section modules 62, 64, and 65 of cell 14.

Figure 3:
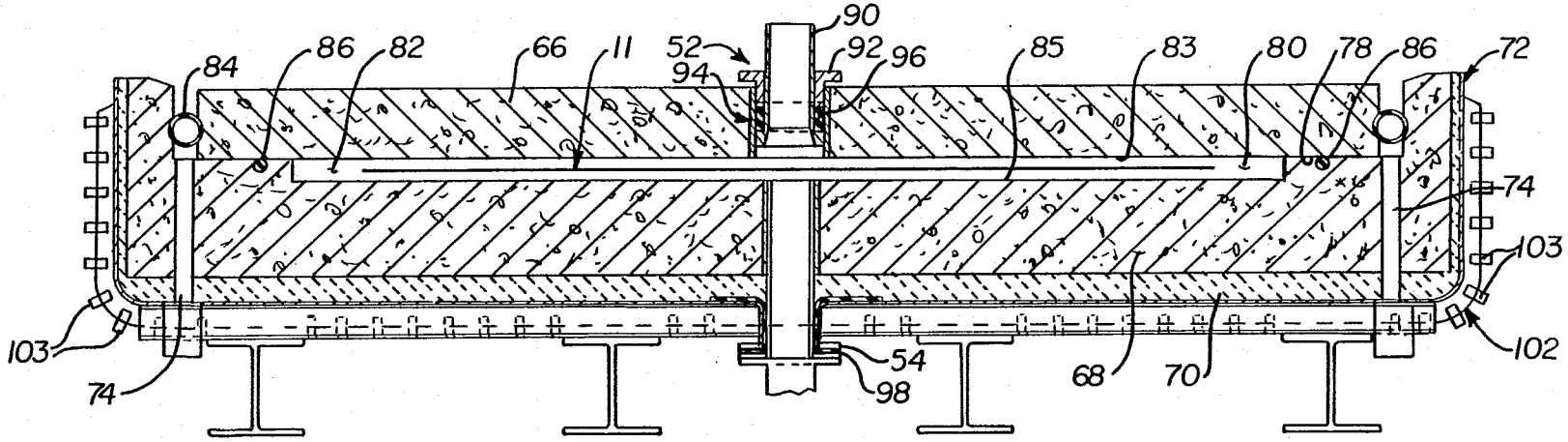
FIG. 3 is an enlarged sectional view of one of the cells of FIG. 1.

FIG. 3 shows a cross section for a typical section module 62 and 64. Each section module 62, 64, 65 comprises a removable top portion 66 and a bottom portion 68 through which conduits 52, 54 respectively, through appropriate means which will be discussed shortly, are mounted. Both portions 66, 68 are substantially solid and are preferably made of a granite or granite-like material used by the chemical processing industry. The top outer surfaces of bottom portion 68 is sloped inwardly to contain casual leakage, washdown water, etc. Drains 74 located at the opposite sides of the bottom portion 68 shown in FIG. 3 return any leakage past seals 86 to the reservoir 42. Horizontal surfaces of bottom portion 68 supports top portion 66 of section modules 62, 64, 65 as shown at 78 in FIG. 3. Recessed area 80 in the top of bottom portion 68 forms a narrow, straight passageway 82 which receives strip 11 in a manner which will be discussed shortly. Passageway 82 preferably measures approximately 2.00 inches deep and 84 inches wide to receive a maximum 72 inch width strip. As can be seen in FIG. 3, the passageway 82 is generally of a rectangular shape similar to that of strip 11, and has a depth with respect to said cross section which is less than three times greater than the maximum thickness of strip 11. The top inner wall 83 and bottom inner wall 85 of passageway 82 is essentially a solid, smooth continuous surface extending the width and length of passageway 82, with only inlets 52 and 54 breaking through. Construction of the bottom portion 68 preferably includes an outer insulating 70 layer inside an outermost rubber-lined steel shell 72 for the cell which encloses the bottom portion 68. Insulating wall 70 can be made of an acid-proof insulating material, such as that known by the trade name of Penn Guard of the Pennwalt Corporation of Philadelphia, Pa.

Between the sidewalls of 68 below its sloping surfaces and the sides of top portion 66 is a circular sealing element 84 which encircles the top of section module 62, 64, 65, which element 84 is above drains 74 used to carry hydrochloric acid out of section modules 62, 64, 65 which escapes past an elastomeric sealing element 86. Sealing element 84 is an inflatable acid-proof rubber tube available in the industry used between each cell 12–22 and their covers or top sections 66, and the respective wringer roll assembly 24–34 to contain both the fumes and the pickling liquor.

Top portion 66 of each section module 62, 64, 65 is easily removable and interchangeable with each other; however, top portion 66 is not to be removed except for major maintenance.

Inlet 52 is mounted in top portion 66 in a manner as shown in FIG. 3. Inlet 52 consists of a nozzle 90 with a threaded portion for receiving gland nut 92 and a flange bottom portion around which a back-up ring 94 and a rubber gland 96 are mounted.

Bottom inlet nozzle 54 has a flanged pipe liner, preferably teflon, which is mounted in bottom portion 68. Nozzle 54 is an integral part of an outer rubber-lined steel casing 72.

Still referring to FIG. 3, a flanged portion 102 is part of encasing 72, and is an integral part of this rubber-lined steel shell 72. These flanged portions 102 are located at each longitudinal end of section module 62, 64, 65 and is used in a manner which will be discussed shortly to interconnect each section modules to their respective adjacent wringer roll assembly 24 through 34.

Figure 4:
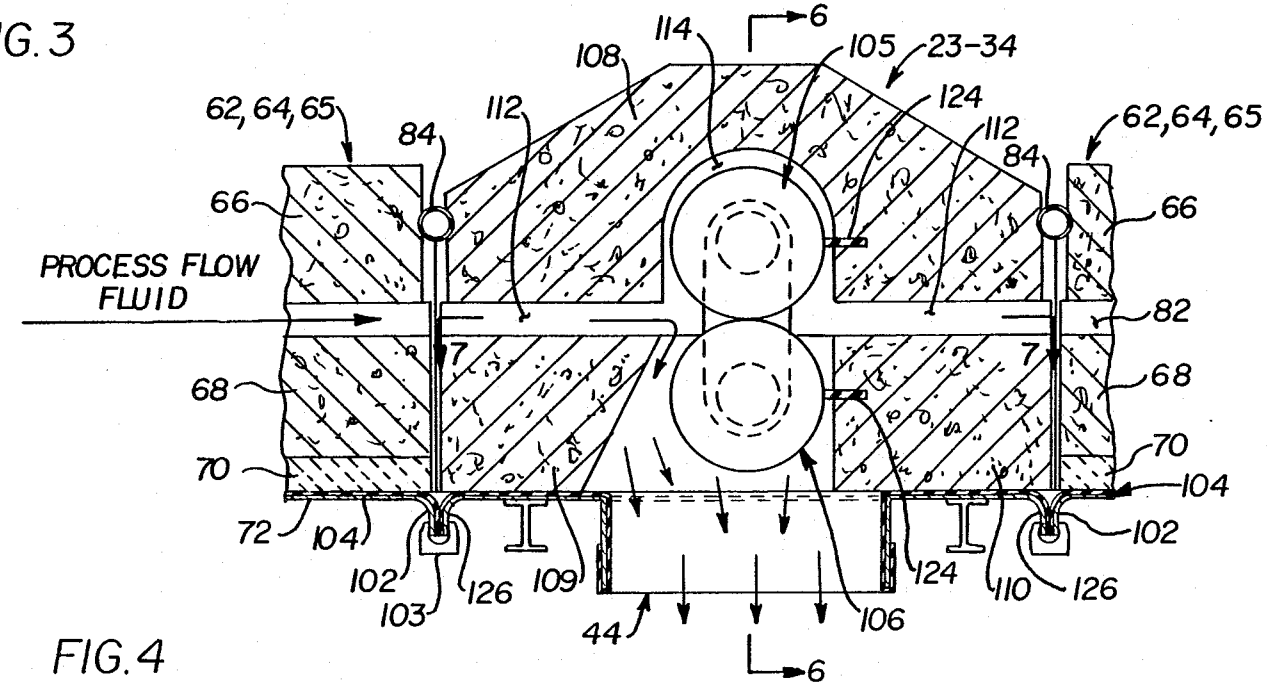
FIG. 4 is an enlarged, sectional view of a wringer roll assembly of the invention as shown in FIG. 1.

In now referring to FIG. 4, flanged portion 102 of section module 62, 64, 65 is an extension of the sides and bottom of casing 72 which as mentioned previously is lined with acid-proof rubber shown at 104, in the same manner as inlet 54 (FIG. 3) is a part of. With reference to FIG. 4, each wringer roll assembly 24–34 consists of a pair of cooperating rolls 105, 106 which preferably is rubber-faced so that they act as squeegee or wringer rolls. These rollers 105, 106 may be motor driven through suitable means (not shown) to feed and push strip in through the pickling arrangement 10, and the length of each roller 105, 106 may be the same or slightly greater than the maximum width strip.

Figure 7:
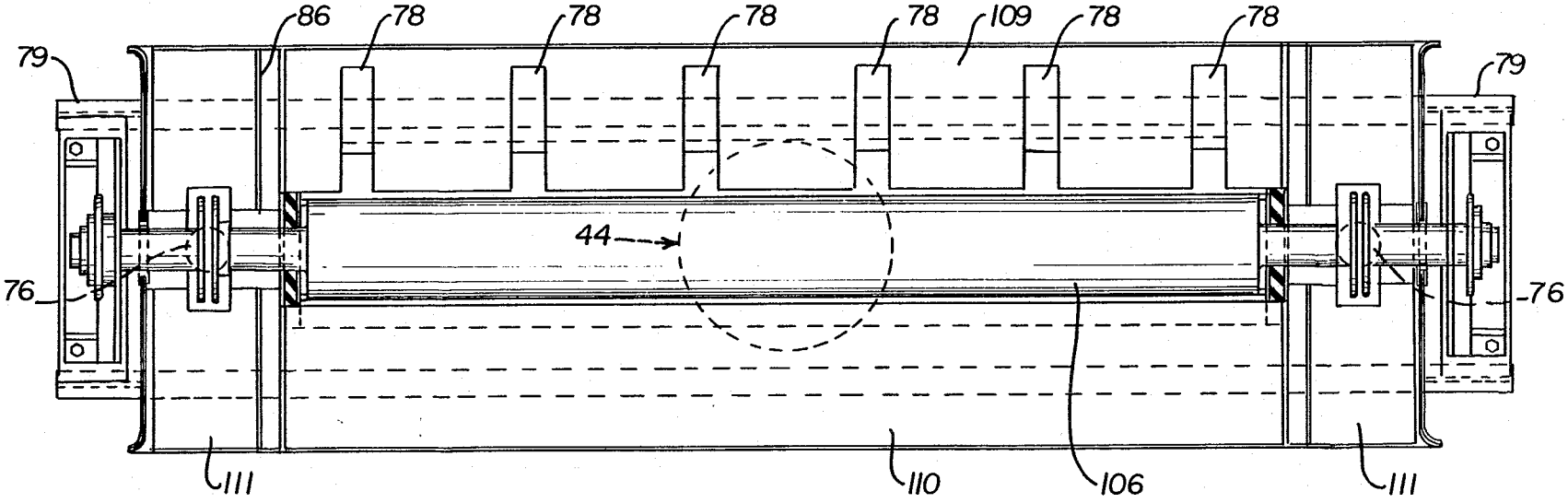
FIG. 7 is a sectional view taken along lines 7—7 of FIG. 4.

Wringer roll assembly 24–34 comprises a housing having an upper portion 108 and lower portions 109, 110, which portions are arranged such as to form a channel 112 which extends at the exit and entry ends of cooperating rollers 105, 106 for receiving strip 11, and which channel 112 is the same height as passageway 82 in section modules 62, 64, 65. Upper portion 108 has a semi-circular void area 114 for receiving top roller 105. The lower roll 106 is located between portions 109, 110. In FIG. 7, weir openings in portion 109 are provided to allow the pickling liquor to flow down and out through drain opening 44 beneath lower roll 106.

Sealing is done between the cell and the wringer roll assembly by seals 84 which preferably is of the inflatable acid-proof rubber tube type. This seal 84 assures a higher fluid pressure in the respective cells 12–22 on each side of wringer roll assemblies 24–34. The relatively equal pressures created thereby aid in retaining the pickling liquor acid in the respective cell 12–22. Still referring to wringer roll assemblies 24–34 of FIG. 4, there is shown to the right side of rolls 105, 106 a sealing plate 124 in portions 108, 110, which plates 124 is of low friction material such as polymerized fluorocarbons, e.g. the commercially available teflon material. These plates 124 are held through suitable means (not shown) in lower and upper portions 108, 110, and are positioned such that pickling liquor forced into these void regions, is dammed, and prevented from escaping from its respective wringer roll assembly 24–34. As further seen in FIG. 4, near drain 44 of wringer roll assembly 24–34 at its juncture with section modules 62, 64, 65, is a rubber lined flanged portion 126 corresponding to and cooperating with flanged portion 102 of section modules 62, 64, 65. These flanged portions 102, 126 are attached together through clamping means 103 so that each wringer roll assembly 24–34 is interconnected to their respective cells 12–22 to form the pickling arrangement 10 of FIG. 1. The flanged portions 102 of each adjacent section modules 62, 64, 65 are fastened together through similar clamping means 103.

Figure 5:
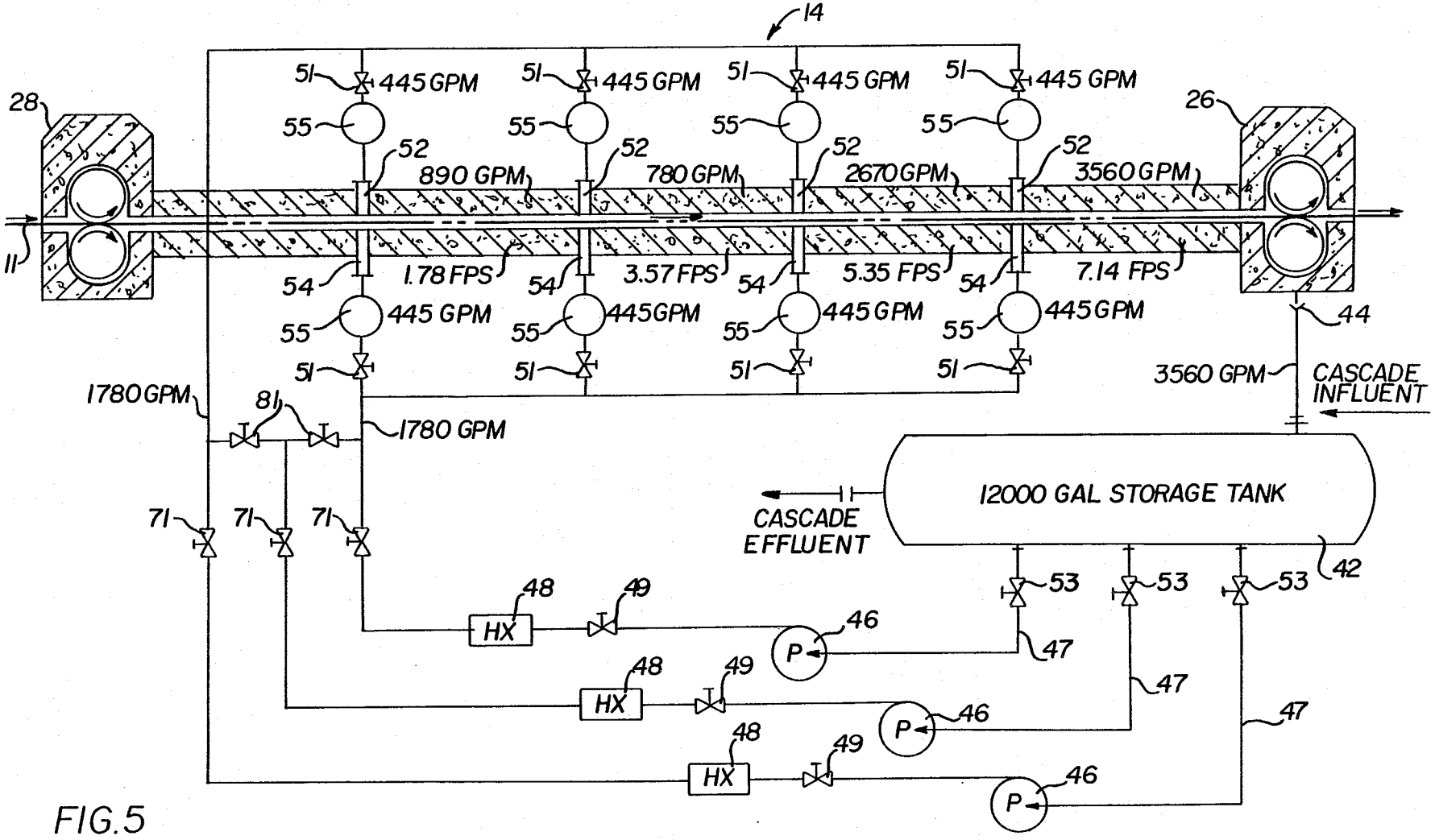
FIG. 5 is a schematic illustrating the fluid flow rates and velocity of a recirculating system for a cell of FIG. 1.

FIG. 5 shows a schematic of a typical preferred hydrochloric acid circulating and recirculating system for each cell 12–22 and will be discussed in accordance with cell 14 with its cooperation wringer roll assemblies 26 and 28 of FIG. 2. Storage tank 42 preferably has a maximum capacity of 12,000 gallons for a high rate of circulation through cell 14 at approximately 3,560 gallons per minute, the operating capacity being approximately 10,700 gallons.

In FIG. 5, storage tank 42 is shown to be connected to a total of three pumps 46. Each pump 46 is connected to a separate heat exchanger 48. Directly to the left and above the heat exchangers 48 is a network of valves 71 and 81 which are opened and closed as necessary to allow for the supply of fluid from at least two of the three pumps 46 and two of the heat exchangers 48, to deliver typically 1,780 gallons per minute each for a total of 3,560 gallons per minute to cell 14. Valves 53 are opened as necessary to allow the flow of fluid from storage tank 42 to respective pumps 46 which are operating. The 1780 gallons per minute from each operating pump 46 is distributed equally to the top and bottom inlet nozzles 52, 54 in cell 14, which distribution is balanced by adjustment of valves 51 as measured by flow meter 55 such that approximately 445 gallons per minute flow through each conduit 52, 54 to impinge upon the center of the top and bottom surfaces of strip 11.

Commencing from the left to the right of FIG. 5 the pickling liquor flows through cell 14 in one direction shown by the horizontal arrows along strip 11. The velocity of the fluid discharged from the first pair of conduits 52, 54 upon impingement of the fluid onto strip 11 cause relatively turbulent conditions and the average fluid velocity between the first and second pair of nozzles 52, 54 is approximately 1.78 feet per second. This velocity will increase in multiples as the strip 11 passes each succeeding pair of conduits 52, 54; the strip 11 travelling at its own constant speed and the fluid travelling at its own progressively increased average speed through the cell 14 at an exit speed of 7.14 feet per second. As the strip 11 passes through the squeegee rollers 105, 106 of wringer roll assembly 26, 28 nearly all of the fluid is dammed by the rolls and forced to exit through drain 44, from where it flows into storage tank 42 for the recirculation process.

Figure 6:
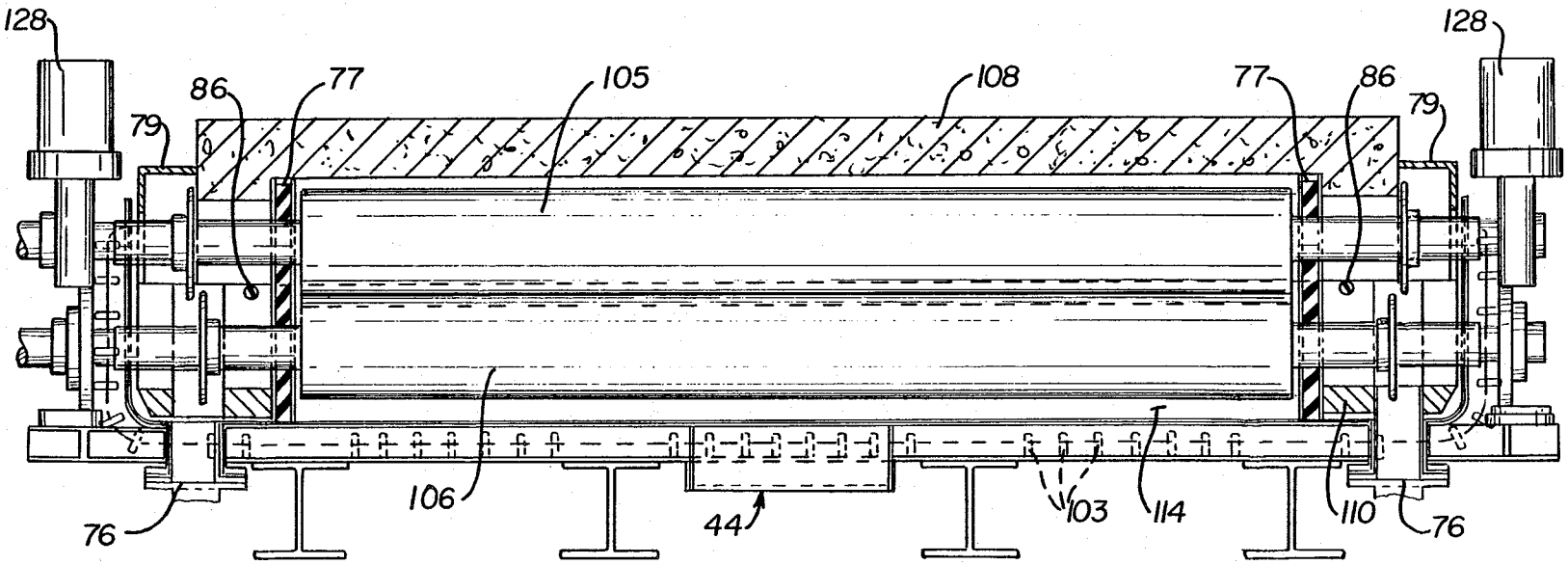
FIG. 6 is a sectional view taken along lines 6—6 of FIG. 4.

Referring to FIGS. 4 and 6, through the sealing elements 84, 86, and wiper elements 124 a positive static pressure is essentially maintained throughout each cell 12–22 to assure total and agitated wetting of strip 11 by the pickling liquor. Referring particularly to FIG. 6, drains 76 conduct leakage past sealing elements 86 and roll neck seals 77 to the respective storage tank 42. Also shown in this FIG. 6 are the bearing block assemblies 79, on opposed sides of rolls 105, 106 and piston cylinder assemblies 128 to provide a pinch force onto the shafts of rolls 105, 106 for the squeegee effect.

The number of pickling cells 12–22 is determined by the maximum speed at which the strip is completely pickled and the overall proportion of the input acid to be reacted with the strip oxide layer, which is based on the known time needed to pickle a strip at the controlled concentration and temperature of the pickling liquor at the surfaces of the strip. This relationship varies for different grades of steel and the hot mill coiling temperature, and other lesser factors. In any case, the length of the pickling arrangement 10 of this invention is shorter, for example, 320 feet as compared to 400 feet for conventional pickling arrangements operating at the same strip speed.

FIGS. 3 and 4 show clamping means 103 used to join each section module 62, 64, 65 together, and with a wringer roll assemblies 24–34. As FIG. 3 shows, several such clamping means 103 are attached at integrals extending the entire peripheral length of flange 102, 126 on both sides and bottom of wringer roll assemblies 24–34 and cells 62, 64, 65. FIG. 4 shows each clamping means 103 as being horseshoe in shape. Clamping means 103 are made of ductile steel by a known manufacturing process, such as stamping, machining, forging or casting and is easily applied by crimping the legs together, and easily disassembled by pulling the legs apart.

Even though the cells 12–22 have been described in a pickling process, it is to be noted that the same arrangement of FIGS. 1–7 can be used in a rinsing stage or other processing stages for the treatment of a strip.

Whereas particular embodiments of the invention have been described above for purposes of illustration, it will be evident to those skilled in the art that numerous variations of the details may be made without departing from the invention as defined in the appended claims.

I claim:

1. An arrangement for treating a generally flat, moving product with top and bottom surfaces, such as a slab, plate, or strip with a treatment fluid, having a relatively higher temperature and higher concentration than otherwise possible comprising:

cell means having a longitudinal relatively straight passageway for forming a passline for said product traveling through said arrangement in a substantially flat disposition, sealing means arranged at the entry and exit ends of said cell means, said sealing means at least at said exit end adapted to retain a substantial amount of said treatment fluid within said cell means, said passageway of said cell means having a generally rectangular cross-section with top and bottom wall areas having significant solid continuous surfaces spaced a relatively short distance from each other to define a narrow, fluid restricting chamber running the length of and parallel to said passline, and said cell means further comprising fluid inlet conduit means mounted in said top and bottom wall areas and having an exit opening in said solid surfaces and located a relatively short distance from each other and said passline for delivering said treatment fluid into said passageway of said cell means to totally immerse said top and bottom surfaces of said product in said fluid whereby said fluid impinges upon a substantially central portion of said top and bottom surfaces of said product in a manner said fluid is forced toward said surfaces of said product and caused to flow parallel to and on said surfaces at a high turbulent velocity rate relative to the speed of said product, said fluid conduit means being a plurality of spaced apart conduit means adapted to increase the speed of said fluid near said surfaces of said product as said portion of said top and bottom surfaces of said moving product progressively pass by each of said inlet conduit means in said cell means to obtain an increasing treatment rate of said moving product upon its travel in said cell means.

2. An arrangement according to claim 1, wherein said each of said plurality of said fluid inlet conduit means includes at least one pair of aligned conduits disposed centrally relative to said cell means and said product, one being mounted on said top wall area and the other being mounted in said bottom wall area, and further including means for applying equal flows into said one and said other conduits in said top and bottom wall areas so that the force of the fluid in said narrow fluid restrictive chamber upon its said impingement on said top and bottom surfaces of said product is such as to create an hydraulic balance on said central portion of said product whereby the edges and surfaces of said product maintain a spaced distance away from said top and bottom wall areas of said narrow, fluid restrictive chamber of said cell means.

3. An arrangement according to claim 1, wherein said cell means has a top and bottom portion and further comprises inflatable tube sealing means surrounding said top portion of said cell means to prevent the escape of fumes and to maintain a desired pressure in said cell means, and support means on said bottom portion of said cell means for supporting said top portion and said inflatable tube sealing means.

4. An arrangement according to claim 1, wherein said cell means further comprises a number of cell units each having top and bottom portions, said bottom portion having insulation means and flanged means at opposed ends of said cell units, and wherein said sealing means is located between at least every two said cell units to seal one cell unit from its adjacent cell unit in order to minimize the back flow of said treating fluid from one said cell to said adjacent cell, and further consists of flange means corresponding to that of said cell units, and a plurality of clamping clips for securing said flange means of said cell units and that of said sealing means together as a unit.

5. An arrangement according to claim 1, wherein said sealing means at least at said exit end of said cell means consists of fluid drainage means, and further comprising a fluid circulation system for said cell means and communicating with said fluid drainage means of said sealing means.

6. An arrangement according to claim 1, wherein said cell means consists of a number of cell units which consists of at least two section modules, wherein said sealing means is located between adjacent said cell units, and wherein each cell unit further consists of a fluid circulation system.

7. An arrangement according to claim 6, wherein said fluid circulation system of each said cell unit consists of a storage tank means and is interconnected to the storage tank means of the circulation system of its adjacent cell unit whereby it receives overflowing fluid from the storage tank means of the immediately downstream circulation system and discharges an equal flow to the storage tank means of the upstream circulation system to assure progressively controlled use of the treating fluid.

8. In an arrangement for treating a generally flat product having top and bottom surfaces with a treating fluid comprising:

cell means consisting of at least one section module, said section module comprising a bottom portion and a top portion supported by said bottom portion, which said portions are spaced a relatively short distance from each other to form a straight, narrow fluid restricted passageway therebetween, with relatively solid, continuous inner wall linings for receiving said product and said fluid, and fluid inlet conduit means mounted in central alignment in said top and bottom portions of said section module and having an exit opening in said solid continuous wall linings of said top and bottom portions of said cell means and located a relatively short distance from each other and said passline for delivering said treating fluid under pressure into said narrow passageway to totally immerse said product in said fluid and in a manner said fluid is forced to flow on and along said surfaces at a high turbulent velocity rate to obtain a relatively high treatment rate of said product, said section module further comprising drain means alongside said passageway, and inflatable tube sealing means located adjacent to said drain means for creating and maintaining a back pressure in said passageway.

9. In an arrangement according to claim 8, wherein said bottom portion has a recessed area and wherein said top portion is a removable generally rectangular cover disposed on inner horizontal surfaces of said bottom portion, and cooperates with said recessed area of said bottom portion to form said passageway and to maintain pressure in said cell means.

10. In an arrangement according to claim 1, further comprising: a wringer roll assembly for removing said treating fluid from said top and bottom surfaces of said product, said wringer roll assembly comprising:

housing means having top and bottom portions, a pair of cooperative wringer rolls, one mounted in said top portion and the other mounted in said bottom portion forming a gap to define a passline for said product, and having an entry end and a delivery end for said product, said top and bottom portions of said housing means closely disposed around and spaced from its respective said wringer roll for forming restricted areas into which said treatment fluid flows to create a vacuum causing said fluid to flow in a predetermined direction relative to said rolls.

11. In an arrangement according to claim 10, wherein said wringer roll assembly further comprises drainage means communicating with said bottom portion of said housing for receiving said fluid removed from said product, and a fluid supply and recirculation system for supplying fresh fluid and recirculating said removed fluid into said cell means.

12. In an arrangement according to claim 10, further comprising sealing plate means in said top and bottom portions of said housing means for retaining the fluid flow within said housing means essentially on said entry end of said housing means.

13. In an arrangement according to claim 1, wherein said cell means comprises a plurality of connectable cell units for said treatment, said cell units each having flanged means abutting cooperative flanged means of an adjacent cell unit, and a plurality of clamping means each having a relatively U-shape channel for receiving said abutting cooperative flange means of said adjacent cell units, and arranged significantly around said connectable components abutting cooperative flange means of said adjacent cell means, and having malleable leg sections which are easily forced together for said securing of said cooperative flange means, and forced apart for easy removal therefrom.

14. An arrangement for pickling ferrous strip while moving along a predetermined path of travel comprising, at least two tandemly arranged pickling cells located along said path of travel, each said cell being made up of a number of generally similarly constructed modules that allow easy and rapid installation in said path, means for causing said strip to pass through said cells to effect treatment thereof, said cells each constructed to have a narrow opening shaped generally similar to the cross sectional shape of the strip and having a depth with respect to said cross section which is less than three times greater than the maximum thickness of said strip, separate means for each pickling cell for introducing pickling solution to said opening of said pickling cells under substantial high turbulence and at different spaced-apart locations and at opposite sides thereof in a manner that the speed of the solution flowing through the cell is substantially different from the speed of the strip and is increased along said locations by at least 10% at each location, means for maintaining said solution in an hydraulic balanced condition relative to the opposite transfer surfaces of the strip to maintain the strip in a substantially non-catenary condition and out of contact with the walls of said cells, means for preventing the solution from one pickling cell from escaping into the adjacent pickling cells including means for creating a back pressure condition at the exit end of each pickling cell, and said means for introducing pickling solution including a solution recirculating system including at least two cooperative interconnected tanks arranged so that the recirculating solution flows in a cascading effect from one tank to the other.

15. An arrangement according to claim 1, wherein said velocity rate of said fluid increases in multiples uponsaid progressive passing of said product by said inlet conduit means.

* * * * *

UNITED STATES PATENT AND TRADEMARK OFFICE

CERTIFICATE OF CORRECTION

PATENT NO. : 4,807,653

DATED : February 28, 1989

INVENTOR(S) : ANTHONY P. CIPRIANO and HOWARD J. BORTMAS

It is certified that error appears in the above-identified patent and that said Letters Patent is hereby corrected as shown below:

Column 1, line 43, "tempratures" should be --temperatures--.

Column 6, line 25, "an" (second occurrence) should be deleted.

Claim 6, column 9, line 65, --said-- should be inserted after "each".

Claim 15, column 12, line 30, "uponsaid" should read --upon said--.

Signed and Sealed this

Thirteenth Day of February, 1990

*Attest:*

JEFFREY M. SAMUELS

*Attesting Officer* *Acting Commissioner of Patents and Trademarks*